US008503897B2

(12) United States Patent
Kwon et al.

(10) Patent No.: US 8,503,897 B2
(45) Date of Patent: Aug. 6, 2013

(54) ELECTROPHOTOGRAPHIC IMAGE FORMING APPARATUS WITH IMPROVED IMAGE TRANSFER

(75) Inventors: Myung-sik Kwon, Suwon-si (KR); Sang-hoon Mun, Yongin-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 337 days.

(21) Appl. No.: 12/868,855

(22) Filed: Aug. 26, 2010

(65) Prior Publication Data

US 2011/0081165 A1 Apr. 7, 2011

(30) Foreign Application Priority Data

Oct. 1, 2009 (KR) ..... 10-2009-0094033

(51) Int. Cl.
*G03G 15/16* (2006.01)
*G03G 15/08* (2006.01)
*G03G 15/01* (2006.01)

(52) U.S. Cl.
USPC ..... 399/66; 399/121; 399/302

(58) Field of Classification Search
USPC ..... 399/66, 121, 302, 303, 308, 312, 399/313
See application file for complete search history.

(56) References Cited

U.S. PATENT DOCUMENTS 5,440,379 A * 8/1995 Hayamizu ..... 399/308
5,822,648 A * 10/1998 Mohri ..... 399/302 X
6,665,507 B1 * 12/2003 Hooper et al. ..... 399/121 X
7,039,337 B2 * 5/2006 Kawaguchi et al. ..... 399/313 X
7,840,148 B2 * 11/2010 Tanaka et al. ..... 399/66
8,059,980 B2 * 11/2011 Okamoto ..... 399/66

* cited by examiner

*Primary Examiner* — Sandra Brase
(74) *Attorney, Agent, or Firm* — Stanzione & Kim, LLP

(57) ABSTRACT

An image forming apparatus may includes an image carrying body, a intermediate transferring unit which includes an intermediate transferring belt to which a visible image on the image carrying body is transferred, a driving roller to drive the intermediate transferring belt, and a first roller support unit to support a rotation shaft of the driving roller. The image-forming apparatus also includes a medium transferring unit to transfer a visible image on the intermediate transferring belt to a printing medium and includes a transferring roller to move between a pressing position pressing the driving roller to interpose the intermediate transferring belt therebetween and a separated position separated from the pressing position, and a second roller support unit to support a rotation shaft of the transferring roller. The pressing position of the transferring roller can be regulated by a contact of the first roller support unit and the second roller support unit.

24 Claims, 18 Drawing Sheets

ELECTROPHOTOGRAPHIC IMAGE FORMING APPARATUS WITH IMPROVED IMAGE TRANSFER

CROSS-REFERENCE TO RELATED APPLICATIONS

This application claims priority under 35 U.S.C. §119(a) from Korean Patent Application No. 10-2009-0094033, filed on Oct. 1, 2009 in the Korean Intellectual Property Office, the disclosure of which is incorporated herein by reference in its entirety.

BACKGROUND

1. Field of the Invention

The present general inventive concept relates to an electrophotographic image forming apparatus, and more particularly, to an electrophotographic image forming apparatus having a consistent image transfer contact region.

2. Description of the Related Art

An electrophotographic image forming apparatus is an apparatus that forms an image on a printing medium through a series of processes including a charging process to charge a drum or roller, an exposing process to expose the charged drum to light, for example, a developing process to attach toner to the exposed portions of the drum, a transferring process to transfer an image from the drum to a recording medium, a fusing process to fuse the image to the recording medium, and a cleaning process to clean the drum.

The image forming apparatus may include an image carrying body, such as a photoconductive drum, an exposing unit to expose a surface of the image carrying body, a developing unit to develop the exposed image carrying body with a developer, a transferring unit to transfer to a printing medium a visible image configured by the developer to be formed on a surface of the image carrying body by the developing process, and a fusing unit to fuse the visible image transferred to the transferring unit to the printing medium with heat and pressure.

Image-forming apparatuses may be classified into a multi pass type, which uses a single image carrying body or photoconductive drum, and a single pass type, which includes a plurality of image carrying bodies in a line along a transporting path of a printing medium to form a color image by a one-time passage of a printing medium.

In a conventional multi pass type image forming apparatus, an intermediate transferring belt faces the single image carrying body or photoconductive drum. After the single image carrying body is exposed and developed by each color of yellow, magenta, cyan, and black, a visible image formed on a surface of the single image carrying body is transferred to the middle transferring belt. By performing these processes by each color, that is, by repeating the charging, exposing, and developing processes four separate times, a final color image overlapped by the four colors is formed on the middle transferring belt.

The final color image on the intermediate transferring belt is transferred to a printing medium that passes between the intermediate transferring belt and a final transferring roller.

The final transferring roller may be movable between a separated position, in which it is separated from the intermediate transferring belt before the final color image is formed, and a contact position, in which it contacts the intermediate transferring belt to transfer from the intermediate transferring belt to a printing medium the final color image.

An arm that supports the final transferring roller contacts an inner frame portion of the image forming apparatus so that the contact position of the final transferring roller is regulated. The arm may have a bent shape, and the arm may be formed of a plastic material that is bendable.

However, since the contact position of the final transferring roller is regulated by a contact of the arm and the inner frame, a transferring contact region formed between the final transferring roller and a driving roller that drives the intermediate transferring belt fails to be uniform in a lengthwise direction, and the quality of an image is apt to be deteriorated.

Since the arm and the inner frame are substantially separated from the rotation shaft of the final transferring roller, the transferring contact region fails to be uniform.

SUMMARY

Accordingly, it is an aspect of the present general inventive concept to provide an image forming apparatus having a uniform transferring contact region.

Another aspect of the present general inventive concept is to provide an image forming apparatus to improve a printing quality.

Additional aspects and utilities of the present general inventive concept will be set forth in part in the description which follows and, in part, will be obvious from the description, or may be learned by practice of the general inventive concept.

Features and/or utilities of the present general inventive concept can be achieved by an image forming apparatus of an electrophotographic type, the image forming apparatus including an image carrying body, a intermediate transferring unit which comprises a intermediate transferring belt to which a visible image on the image carrying body is transferred, a driving roller to drive the intermediate transferring belt, and a first roller support unit to support a rotation shaft of the driving roller, and a medium transferring unit which transfers a visible image on the intermediate transferring belt to a printing medium and comprises a transferring roller that moves between a pressing position pressing the driving roller to interpose the intermediate transferring belt therebetween and a separated position in which the medium transferring unit is separated from the driving roller of the intermediate transferring belt, and a second roller support unit to support a rotation shaft of the transferring roller, the pressing position of the transferring roller being regulated by a contact of the first roller support unit and the second roller support unit.

One of the first roller support unit and the second roller support unit may include a bearing.

The other of the first roller support unit and the second roller support unit may include a position regulating ring comprising a protrusion protruding toward the bearing.

The other of the first roller support unit and the second roller support unit may further include a bearing to support the rotation shaft of the driving roller and to be inserted in an inner part of the position regulating ring.

The second roller support unit may rotate between the pressing position and the separated position.

The medium transferring unit may further include a driving unit to move the transferring roller to the separated position and/or the pressing position.

The driving unit may include an elastic member which elastically biases the transferring roller to the separated position, and an operating unit which moves the transferring roller to the pressing position.

The operating unit may include a driving lever which rotates about a hinge pivot being in parallel with a rotation shaft of the transferring roller, and drives the second roller support unit, and a cam which selectively presses a first end part of the driving lever.

The elastic member may be disposed between a second end part of the driving lever and the second roller support unit.

Features and/or utilities of the present general inventive concept may also be realized by a transferring unit which is disposed to an image forming apparatus including an image carrying body, a intermediate transferring belt to which a visible image on the image carrying body is transferred, a driving roller driving the intermediate transferring belt, and a first roller support unit that supports a rotation shaft of the driving roller and transfers a visible image from the intermediate transferring belt to a printing medium. The transferring unit may include a transferring roller to move between a pressing position pressing the driving roller to interpose the intermediate transferring belt therebetween, and a separated position separated from the pressing position, and a second roller support unit to support a rotation shaft of the transferring roller, the pressing position of the transferring roller being regulated by a contact of the first roller support unit and the second roller support unit.

One of the first roller support unit and the second roller support unit may include a bearing.

The other of the first roller support unit and the second roller support unit may include a position regulating ring including a protrusion protruding toward the bearing.

The other of the first roller support unit and the second roller support unit may further including a bearing to support the rotation shaft of the driving roller and to be inserted in an inner part of the position regulating ring.

Features and/or utilities of the present general inventive concept may also be realized by an intermediate transferring unit in an image forming apparatus, the intermediate transferring unit including an intermediate transferring belt to which a visible image on an image carrying body in the image forming apparatus is transferred, a driving roller to drive the middle transferring belt, and a position regulating ring which is located on a rotation shaft of the driving roller, and including a protrusion partially protruding from the position regulating ring.

The intermediate transferring unit may further include a first bearing to support the rotation shaft of the driving roller.

The position regulating ring may be disposed to an outer surface of the first bearing.

The image forming apparatus may include a medium transferring unit to transfer a visible image from the intermediate transferring belt to a printing medium and a transferring roller to move between a pressing position pressing the driving roller to interpose the intermediate transferring belt therebetween and a separated position separated from the pressing position, and a roller support unit to support a rotation shaft of the transferring roller.

The pressing position of the transferring roller may be regulated by a contact of the position regulating ring and the roller support unit.

The roller support unit may include a second bearing supporting the rotation shaft of the transferring roller.

The roller support unit may rotate between the pressing position and the separated position.

Features and/or utilities of the present general inventive concept may also be realized by an image-forming apparatus including an intermediate image-transfer unit including an intermediate image transfer belt to receive an image to transfer to a recording medium and a driving roller to drive the intermediate image transfer belt, a recording medium transfer roller to move to an image transfer position in contact with the driving roller. One of the recording medium transfer roller and the driving roller may include at least one roller separation protrusion to maintain at a predetermined distance the first driving roller and the recording medium transfer roller when the driving roller and the recording medium transfer roller are in the image transfer position.

The separation protrusion may be located on a roller support unit to support a shaft of one of the driving roller and the recording medium transfer roller.

The roller support unit may include a bearing to support a shaft of one of the first driving roller and the recording medium transfer roller and a positioning ring located around an outer circumference of the bearing. The separation protrusion may extend from an outer circumferential surface of the positioning ring.

The separation protrusion may be located on a shaft of one of the driving roller and the recording medium transfer roller.

One of the driving roller and the recording medium transfer roller may include a core having a hole to receive the shaft and rotate around the shaft and an elastic portion surrounding the core an outer circumference of the core.

Each of the driving roller and the recording medium transfer roller may include an elastic portion located around an outer circumference of each respective roller, and the elastic portions of the respective rollers may press against each other when the driving roller and the recording medium transfer roller are in the image transfer position.

The one of the recording medium transfer roller and the driving roller that includes the at least one roller separation protrusion may have a roller separation protrusion at each end of the roller in a lengthwise direction of the roller.

The recording medium transfer roller may include a first roller support unit to support a shaft of the recording medium transfer roller and the driving roller may include a second roller support unit to support a shaft of the driving roller, the separation protrusion may be located on one of the first and second roller support units, and the separation protrusion located on one of the first and second roller support units may contact an outer circumferential surface of the other of the first and second roller support units.

Each of the driving roller and the recording medium transfer roller may include a separating protrusion, and the separating protrusion of the driving roller may contact the separating protrusion of the recording medium transfer roller when the driving roller and the recording medium transfer roller are in the image transfer position.

The separating protrusion may be located on the recording medium transfer roller and may extend towards the driving roller.

The separating protrusion may be located on the driving roller and may extend towards the recording medium transfer roller.

The image-forming apparatus may include a roller support lever to support the recording medium transfer roller and to move the recording medium transfer roller between the image transfer position and a separated position in which the recording medium transfer roller is separated from the driving roller.

The image-forming apparatus may further include a driving lever to rotate around a hinge pivot, a cam to contact a first end of the driving lever, the cam having a protruding portion and a shaft portion, a biasing member connected to a second end of the driving lever and to the roller support lever to elastically bias the roller support lever in the separated position. When the protruding portion of the cam presses against a first end of the driving lever, a second end of the driving lever opposite the first end may press the biasing member to press the driving lever into the image transfer position, and when the protruding portion of the cam does not press against the first end of the driving lever, the biasing member may pull the driving lever into the separated position.

Features and/or utilities of the present general inventive concept may also be realized by an image-forming apparatus including an image-forming unit to form an image on a photosensitive unit, a recording medium transfer unit to transfer the image to a recording medium, and an intermediate image-transfer unit to transfer the image from the image-forming unit photosensitive unit to the recording medium transfer unit. The intermediate image-transfer unit may include an image-transfer belt to receive the image from the photosensitive unit and a driving roller to roll the image-transfer belt along an outer circumferential surface of the driving roller. The intermediate image-transfer unit may include a recording medium transfer roller to move to an image transfer position in contact with the driving roller and a separated position apart from the driving roller, and one of the recording medium transfer roller and the driving roller may include at least one roller separation protrusion to maintain at a predetermined distance the first driving roller and the recording medium transfer roller when the driving roller and the recording medium transfer roller are in the image transfer position.

The image-forming apparatus may further include a controller to control operation of the image-forming unit, recording medium transfer unit, and intermediate image-transfer unit, including movement of the recording medium transfer roller between the image transfer position and the driving position.

Features and/or utilities of the present general inventive concept may also be realized by an image-transfer apparatus of an image-forming apparatus, the image-transfer apparatus including a first image-transfer unit including a first roller, the first image-transfer unit to receive a multi-color image and a second image-transfer unit including a second roller to move to an image transfer position in contact with the first roller and to a separated position separate from the first roller. One of the first roller and the second roller may include at least one roller separation protrusion to maintain the first roller and the second roller at a predetermined distance from each other when the first roller and the second roller are in the image transfer position.

BRIEF DESCRIPTION OF THE DRAWINGS

The present general inventive concept will become apparent and more readily appreciated from the following description of the exemplary embodiments, taken in conjunction with the accompanying drawings, in which.

DETAILED DESCRIPTION OF THE EMBODIMENTS

Figure 1:
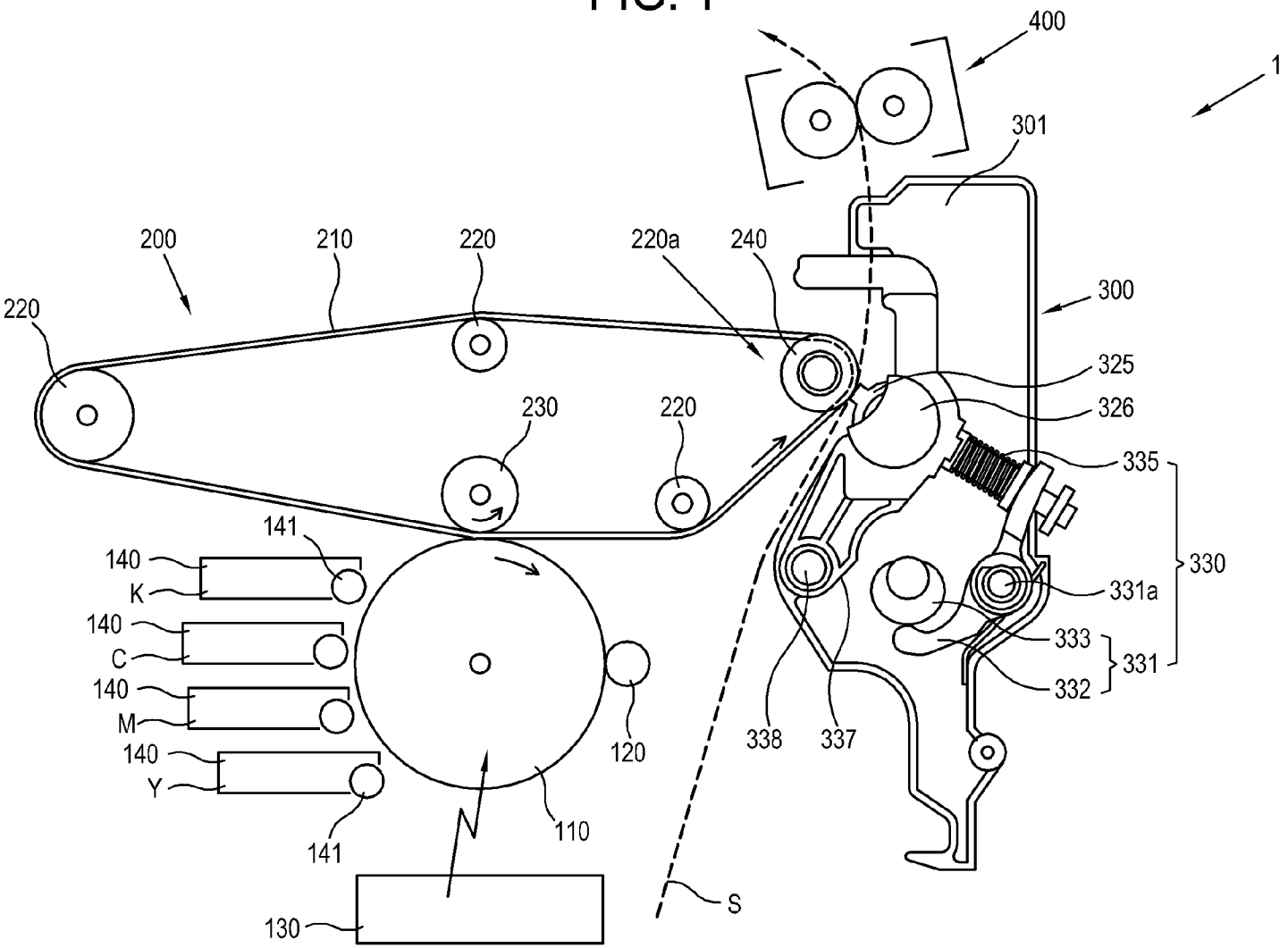
FIG. 1 is a schematic sectional view of an image forming apparatus according to the present general inventive concept.

Reference will now be made in detail to the embodiments of the present general inventive concept, examples of which are illustrated in the accompanying drawings, wherein like reference numerals refer to like elements throughout. The exemplary embodiments are described below so as to explain the present general inventive concept by referring to the figures. Repetitive description with respect to like elements of different embodiments may be omitted for clarity. Hereinafter, an image forming apparatus, a transferring unit, and an intermediate transferring unit according to an exemplary embodiment of the present general inventive concept will be described in detail.

Referring to FIG. 1, an image forming apparatus 1 according to embodiments of the present general inventive concept may include an image carrying body 110 or photoconductive drum, a charging roller 120 to charge the image carrying body 110 so that a surface of the image carrying body 110 can have a predetermined surface electric potential, an exposing unit 130 to expose the charged image carrying body 110 to a light, for example, a plurality of developing cartridges 140 to develop a surface of the image carrying body 110 exposed by the exposing unit 130 with a developer stored in the developing cartridges 140, a intermediate transferring unit 200, or intermediate image transfer unit, to receive the developed image from the image-carrying body 110, a recording medium transfer unit 300 to transfer the visible image from the intermediate image transfer belt 210 of the intermediate image transfer unit 200 to a printing medium, such as paper, and a fusing unit 400 to fuse onto the printing medium by heat and/or pressure the visible image transferred to the printing medium from the intermediate image transfer belt 210.

The image carrying body 110 may be a photosensitive body, such as a photoconductive drum or roller, and may have a surface formed of an organic photosensitive material.

The plurality of developing cartridges 140 may store respective developers or toners of predetermined colors, such as yellow Y, magenta M, cyan C, and black K, and each developing cartridge 140 may have a corresponding developing roller 141 to applying the developer to the image carrying body 110.

The intermediate image transfer unit 200 may include the intermediate image transfer belt 210, a plurality of driving rollers 220 to drive the intermediate image transfer belt 210, and a middle transfer roller 230 to face the image carrying body 110 having the intermediate image transfer belt 210 positioned between the middle transfer roller 230 and the image carrying body 110 to transfer an image from the image carrying body 110 to the intermediate image transfer belt 210.

As illustrated in FIGS. 1, 2, 3A, and 5, the recording medium transfer unit 300 includes a frame 301 located in the image forming apparatus 1 and removable from the image-forming apparatus 1. The recording medium transfer unit 300 also includes a recording medium transfer roller 320 facing a driving roller 220*a* of the plurality of driving rollers 220. The intermediate image transfer belt 210 moves along an outer surface of the driving roller 220*a* and is located between the driving roller 220*a* and the recording medium transfer roller 320.

The recording medium transfer roller 320 is includes a shaft 321 mounted to a roller support lever 337. The roller support lever 337 is mounted to the frame 301 to move between a pressing position in which the recording medium transfer roller 320 contacts the driving roller 220*a* and a separated position in which the recording medium transfer roller 320 is separated from the driving roller 220*a*.

A process of forming a color image in the image forming apparatus 1 having the above configurations is as follows. First, the image-carrying body 110 is charged to a pre-determined charge and exposed to a light that forms an exposing pattern on the surface of the image-carrying body 110. The first exposed portion of the image-carrying body may correspond to portions of the image that require yellow, for example. Accordingly, a surface of the image carrying body 110 is formed with an electrostatic latent image corresponding to the yellow portions of the image.

The developing roller 141 of the yellow developing cartridge 140Y is moved adjacent to the image carrying body 110 so that the yellow developer in the yellow developing cartridge 140Y is transferred to the electrostatic latent image by a static electricity force. Accordingly, a visible image including the yellow developer is formed on the surface of the image carrying body 110. During the yellow developer application stage, each developer 141 of the other developing cartridges 140M, 140C and 140K is separated from the image carrying body 110 so that developers of other colors are not applied to the image carrying body 110.

The yellow visible image on the image carrying body 110 is transferred to the intermediate image transfer belt 210 by the middle image transfer roller 230.

Figure 5:
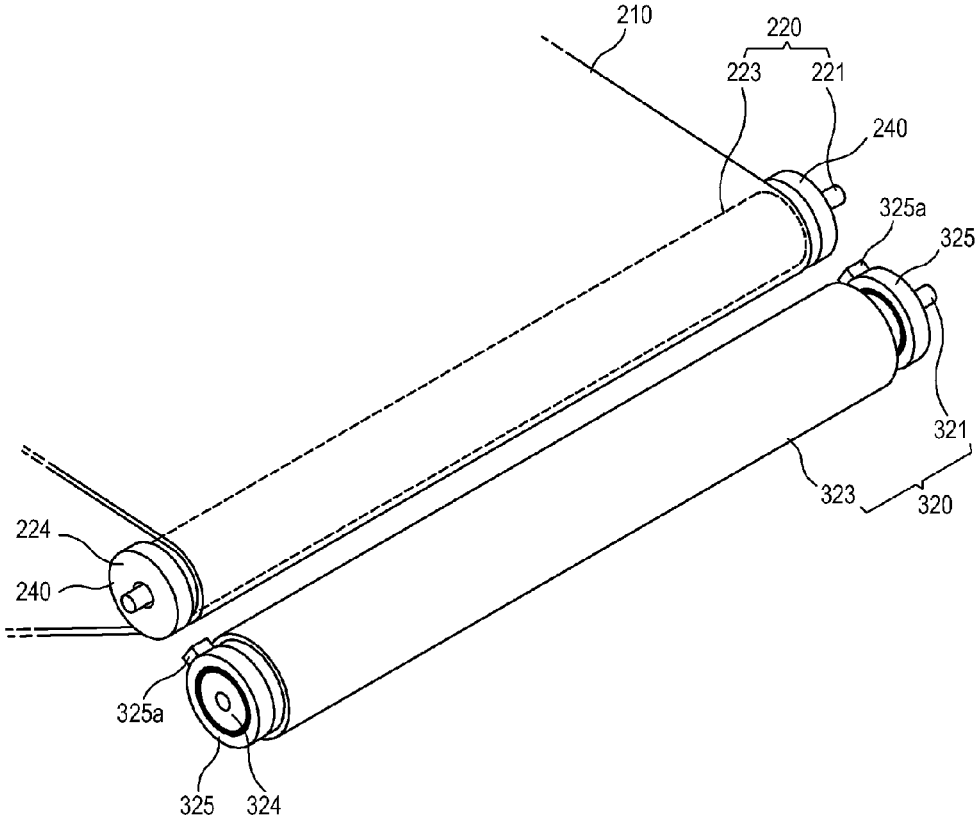
FIG. 5 is a schematic perspective main portion view of the image forming apparatus in FIG. 1.

At this time, the recording medium transfer roller 320 in FIG. 5 of the medium transferring unit 300 is separated from the driving roller 220*a* and remains in the separated state until a final color image is formed on the intermediate image-transfer belt 210. Accordingly, the intermediate image transfer belt 210 may be moved past the recording medium transfer roller 320 without applying an image to the roller 320 or to a recording medium P.

Next, the image-carrying body 110 may again be charged to a predetermined level and exposed with a light to form a latent electrostatic image on the image-carrying body corresponding to a portion of the final image that includes the color magenta.

Then, the magenta developing cartridge 140M is moved adjacent to the surface of the image carrying body 110, and a visible image formed of the magenta developer is formed on the surface of the image carrying body 110.

The magenta visible image is transferred to the intermediate image transfer belt 210, which already includes the yellow visible image. The magenta visible image may overlap portions of the yellow visible image.

Next, the above process is repeated to transfer a cyan visible image and a black visible image to the intermediate image-transfer belt 210.

Once the visible images of each color have been transferred to the intermediate image-transfer belt 210, the image on the surface of the intermediate image-transfer belt 210 corresponds to the desired multi-color image.

At this time, the recording medium transfer roller 320 in FIG. 5 of the medium transferring unit 300 is moved to the pressing position to press against the driving roller 220*a*, and the intermediate image transfer belt 210 that surrounds a part of the driving roller 220*a* is sandwiched between the driving roller 220*a* and the recording medium transfer roller 320.

Also, a printing medium passes between the intermediate image transfer belt 210 and the recording medium transfer roller 320 in FIG. 5 along a transportation path S.

As the printing medium passes between the rollers 220*a* and 320, the final color visible image on the intermediate image-transfer belt 210 is transferred to the printing medium by an electrostatic attraction of the transferring roller 320 in FIG. 5.

The image is then fused onto the printing medium by heat and/or pressure of the fusing unit 400, and the printing medium is discharged to outside the image-forming apparatus 1.

As illustrated in FIGS. 1-5, the intermediate image-transfer unit 200 may include a first roller support unit 240 to support a rotation shaft 221 of the driving roller 220*a*. In other words, the first roller support unit 240 may be a bearing 224, or may include a bearing, that is fixed with respect to the frame of the image-forming apparatus 1, and the shaft 221 may rotate within a hole formed in the bearing 224.

The driving roller 220*a* may further include an elastic layer 223 surrounding a circumference of the rotation shaft 221. The elastic layer 223 may be formed of an electric conductive material, for example, or may have an electric conductive material coated on an outside circumference of the elastic layer 223. A roller core 222 may be formed between the shaft and the elastic layer 223. The roller core 222 may have a hardness similar to that of the shaft 221 and may have a diameter greater than that of the shaft 221.

As illustrated in FIGS. 1-3B and 6, the recording medium transfer unit 300 includes a second roller support unit 340 to support the rotation shaft 321 of the recording medium transfer roller 320.

The recording medium transfer roller 320 may further include an elastic layer 323 to surround the rotation shaft 321. The elastic layer 323 may be formed of an electric conductive material, for example. A roller core 322 may be located between the shaft 321 and the elastic layer 323 of the recording medium transfer roller. 320. The roller core 322 may have a hardness similar to that of the shaft 321 and may have a diameter greater than that of the shaft 321.

The pressing position of the recording medium transfer roller 320 is determined by the manner in which the recording medium transfer roller 320 contacts the driving roller 220*a*. When only the elastic layers 223 and 323 contact each other, the contact area N of the elastic layers 223 and 323, and any recording medium P positioned between the two elastic layers 223 and 323, may be uneven. However, according to the present general inventive concept, the roller support 240 of the driving roller 220*a* may contact the roller support 340 of the recording medium transfer roller 320 to maintain a consistent contact area width N over the length of the rollers 220*a* and 320.

The first roller support unit 240 may include a bearing 224, or may be a bearing, including a hole to support the rotation shaft 221 of the driving roller 220*a*. A portion of the bearing 224 of the first roller support unit 240 may be exposed to contact the second roller support unit 340.

The second roller support unit 340 may include a bearing 324 to support the shaft 321 of the roller 320. A position regulating ring 325 ("positioning ring") having a protrusion 325*a* ("positioning protrusion") protruding toward the first roller support unit 224 may be mounted to or formed on an outer circumference of the roller support unit 340.

In other words, each of the first and second roller support units 240 and 340 may include or comprise a bearing 224 and 324 including a hole to support the shafts 221 and 321 of the driving roller 220*a* and the recording medium transfer roller 320, respectively. A positioning ring 325 including a protrusion 325*a* may be formed, mounted, or attached around the outside circumference of the bearing 324 of the second roller support unit 340, and the protrusion 325*a* may contact the bearing 224 of the first roller support unit 224 when the rollers 220*a* and 320 are in the pressing position.

Alternatively, the position regulating ring 325 may be directly mounted to or formed on the rotation shaft 321 of the transferring roller 320 instead of on the bearing 324. In such a case, the rotation shaft 321 may remain fixed with respect to the frame of the image-forming apparatus and the bearing 324 and elastic portion 323 may rotate around the shaft 321. The shaft 321 may be formed such that the radius of a part of the rotation shaft 321 to which the position regulating ring 325 is mounted or formed can be larger than a radius of other parts of the shaft 321. In other words, when the positioning ring 325 is mounted to the recording medium transfer roller 320, the positioning ring 325 may move with the roller 320 between the pressing position and the separated position. However, in each of the pressing position and the fixed position, the positioning ring 325 remains fixed with respect to the frame of the image-forming apparatus, while the roller rotates with respect to the frame of the image-forming apparatus.

Figure 11A:
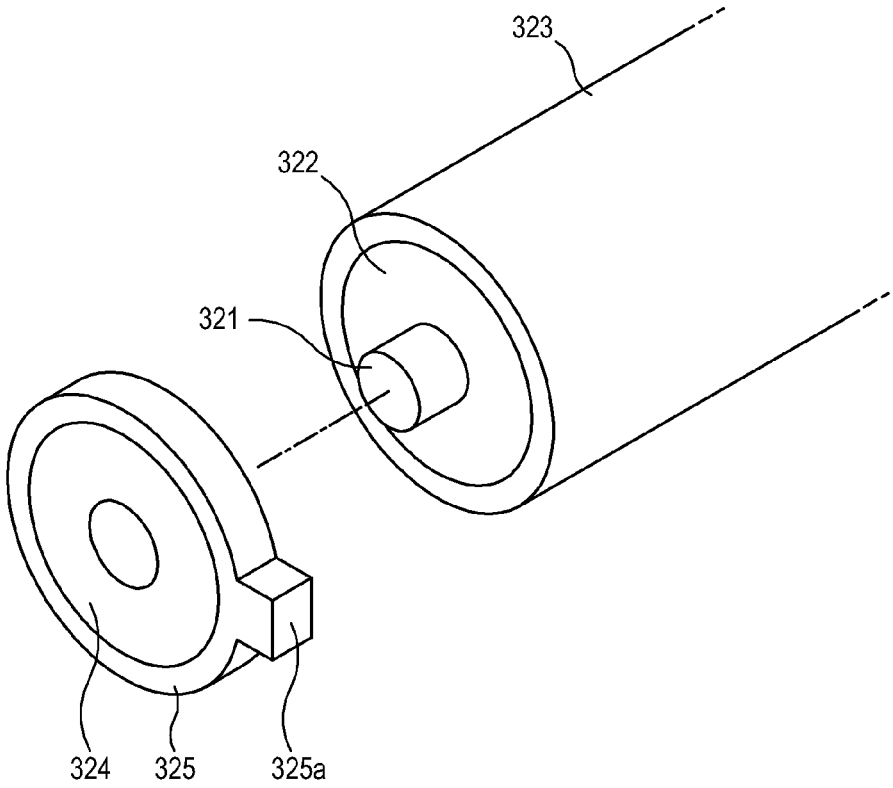
FIGS. 11A and 11B illustrate a separating protrusion on the driving roller according to an embodiment of the present general inventive concept.
Figure 11B:
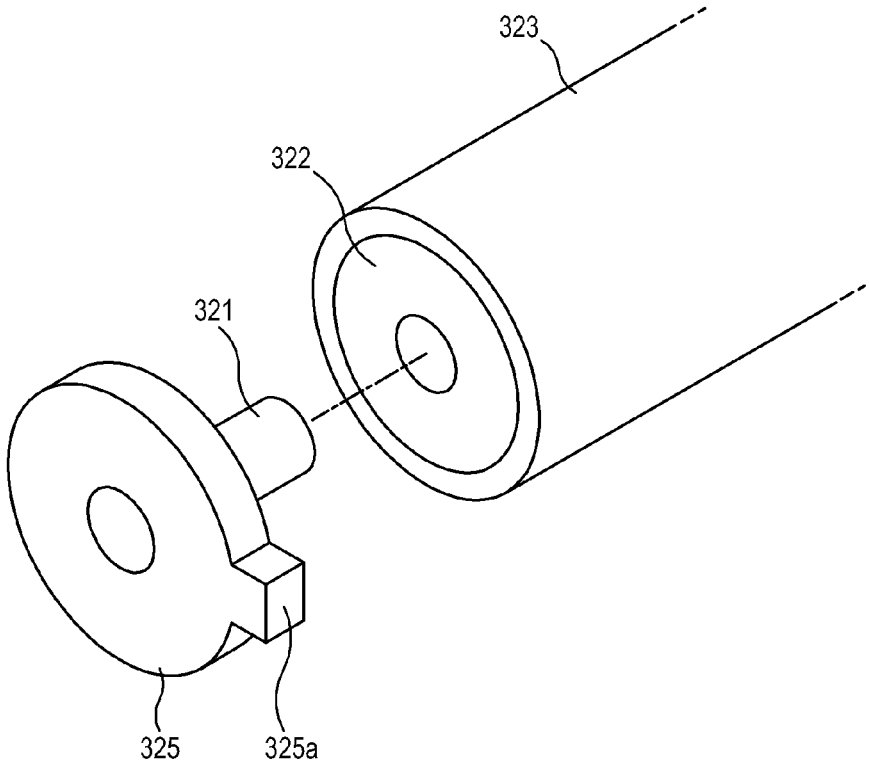

FIGS. 11A and 11B illustrate examples of the positioning ring 325 being formed on or mounted to an outer circumference of the bearing 324 and the shaft 321, respectively. In FIG. 11A, the roller support unit 340 includes a bearing 324 and a positioning ring 325 formed around an outer circumference of the bearing 324. The positioning ring 325 may be integral with the bearing, or in other words, it may be made of the same material and formed in the same process as the bearing 324. Alternatively, the position regulating ring 325 may be formed separately from the bearing 324 and mounted to the bearing 324. The bearing 324 may be fixed with respect to a frame of the image-forming apparatus 1. The shaft 321 of the roller 320 may fit in a hole in the bearing 324 to rotate the roller 320.

On the other hand, in FIG. 11B, the roller support unit 340 includes the shaft 321 and a positioning ring 325 formed around an outer circumference of the shaft 321. The shaft 321 may be fixed with respect to a frame of the image-forming apparatus 1. The roller 320 may include a roller core 322 having a hole to receive the shaft 321. The elastic layer 323 may be mounted to the roller core 322, and the roller core 322 and the elastic layer 323 may rotate around the stationary shaft 321.

Figure 10:
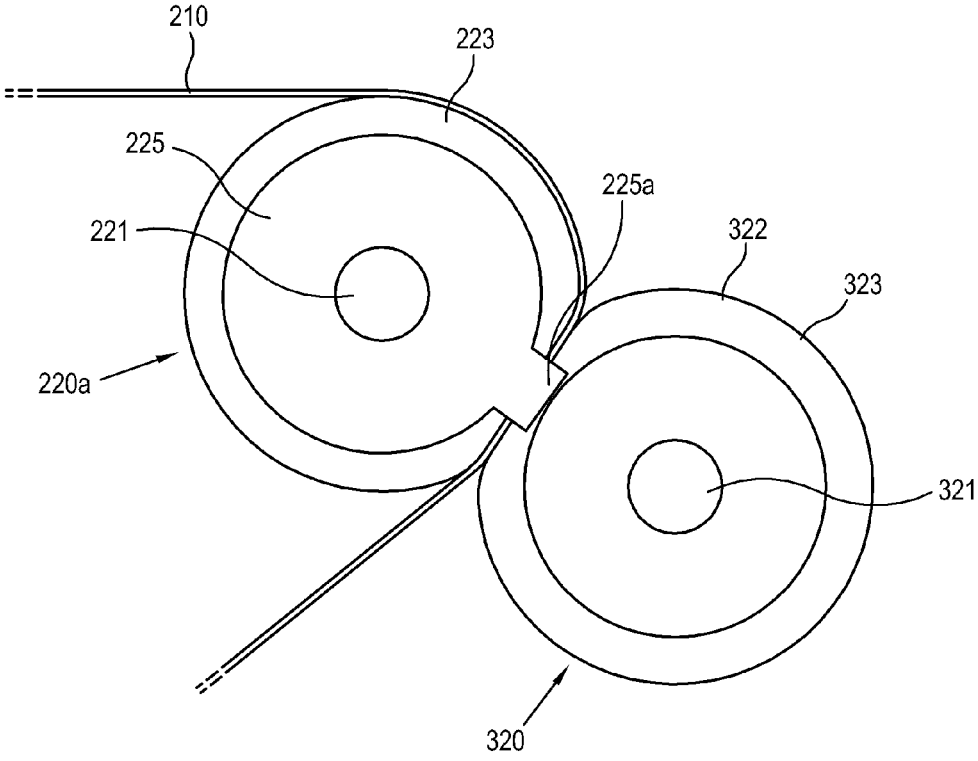
FIG. 10 illustrates a position-regulating ring and protrusion on the belt-driving roller.

Alternatively, a position regulating ring 225 ("positioning ring") may be formed or mounted on the end of the driving roller 220*a* facing the recording medium transfer roller 320 instead of being formed or mounted onto the recording medium transfer roller 320. For example, as illustrated in FIG. 10, the position regulating ring 225 may be mounted or formed on a bearing 224 of the roller support unit 240, and the bearing 224 may include a hole in which the shaft 221 may rotate to rotate the driving roller 220*a*. Alternatively, the positioning ring 225 may be mounted or formed directly on the rotation shaft 221 of the driving roller 220 roller support unit 224. In such a case, the shaft 221 may be fixed with respect to a frame of the image-forming apparatus 1 and a bearing 224 of the roller support unit 240 may rotate around the shaft 221. The configurations in which the positioning ring 225 is formed on the roller bearing 224 and the shaft 221, respectively, are similar to those illustrated in FIGS. 11A and 11B with respect to the recording medium transfer roller 320. Also, a protrusion 225*a* may be formed on the positioning ring 225 similar to the positioning ring 325 described above.

As another alternative, each of the driving roller 220*a* and the recording medium transfer roller 320 may include a respective positioning ring 225 and 325.

Also, as shown in FIGS. 1, 2, 3A, and 4A~4C, the second roller support unit 320 may further include a cap frame 326 to cover the ends of the rotation shaft 321 of the recording medium transfer roller 320. The cap frame 326 may support the ends of the rotation shaft 321.

The recording medium transfer roller 320 may be mounted to a roller support lever 337. The roller support lever 337 may rotate around a shaft 321*a* that is mounted to the frame 301 of the recording medium transfer unit 300. The fixed portion of the roller 320 may be mounted to the support lever 337. For example, if the second shaft support unit 320 is fixed and the shaft 321 rotates in a hole in the second shaft support unit 320, then the second shaft support unit 320, the supporting ring 325, and the cap frame 326 may all be mounted to or fixed with respect to the roller support lever 337.

The cap frame 326 may be omitted as necessary.

The roller support lever 337 may rotate about the revolution shaft 338 which is substantially parallel to the rotation shaft 321. As necessary, the roller support lever 337 may be able to slide instead of or in addition to rotating about the revolution shaft 338. For example, the revolution shaft 338 may be replaced by a rail, and the roller support lever 337 may slide along the rail into a pressing position or a separated position.

Figure 3A:
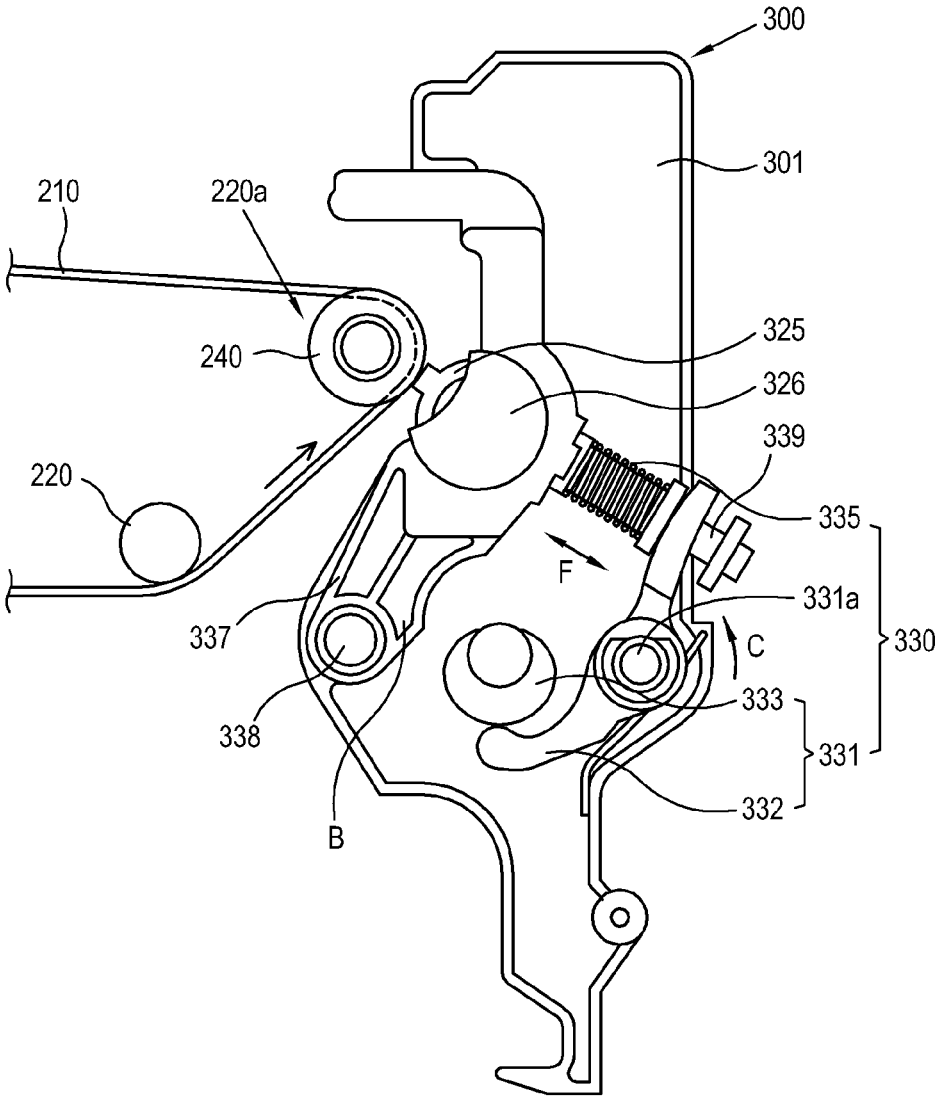
FIG. 3A is an enlarged main portion view of the case that the transferring roller of the image forming apparatus in FIG. 1 is positioned in a pressing position.

The roller support lever 337 may further include, or may be connected to, an extending unit 339 in FIG. 3A that extends toward an elastic member 335, biasing member, or spring, so that an end part of the extending unit 339 is connected to a driving lever 332. The extending unit 339 may be located within the elastic member or biasing member 335, for example.

Also, the medium transferring unit 300 further includes a driving unit 330 to move the recording medium transfer roller 320 between the separated position and the pressing position.

The driving unit 330 includes the elastic member 335, such as a spring, to elastically bias the recording medium transfer roller 320 to the separated position and an operating unit 331 to move the recording medium transfer roller 320 to the pressing position.

The operating unit 331 includes the driving lever 332 which rotates about a hinge pivot 331*a* mounted to the frame 301 and which drives the second roller support unit 320, and a cam 333 selectively pressing a first end part 332*a* of the driving lever 332.

Figure 6:
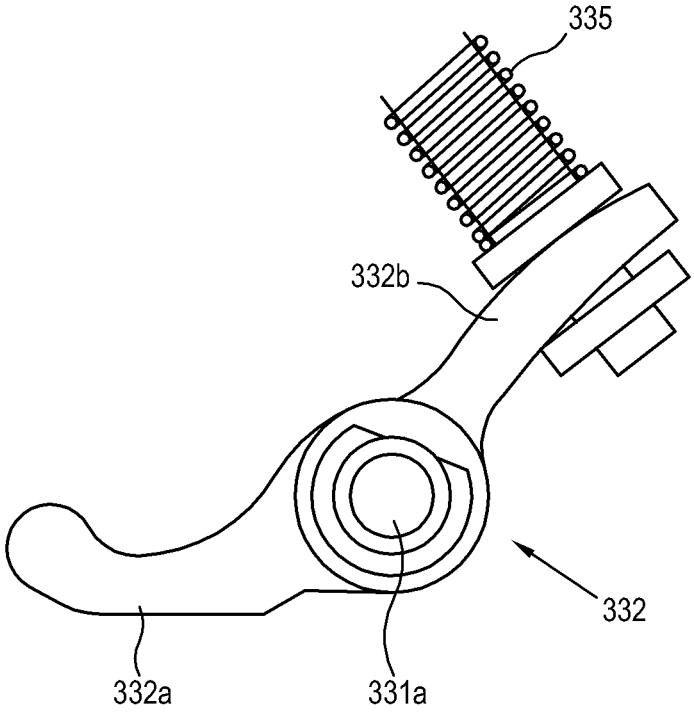
FIG. 6 illustrates the driving lever.

The elastic member 335 is disposed between a second end part 332*b* of the driving lever 332 and the second roller support unit 320. FIG. 6 illustrates the driving lever 332. The driving lever 332 has a center portion mounted to a hinge pivot 331*a*. A first end 332*a* on one end of the hinge pivot 331*a* contacts the cam 333, and a second end 332*b* on the other end of the hinge pivot 331*a* contacts the elastic member 335, or spring.

Figure 2A:
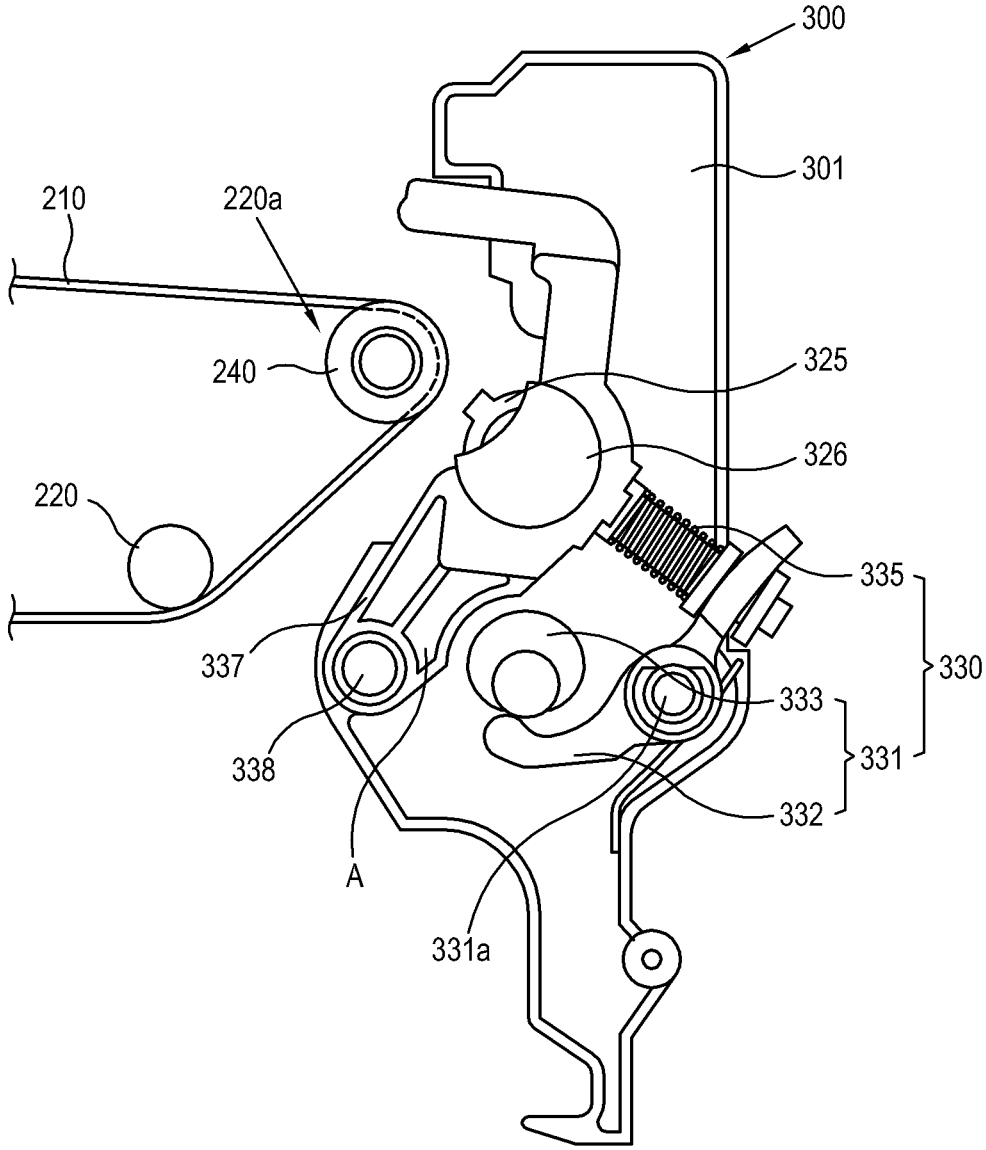
FIG. 2A is an enlarged main portion view of the case that a transferring roller of the image forming apparatus in FIG. 1 is positioned in a separated position.
Figure 2B:
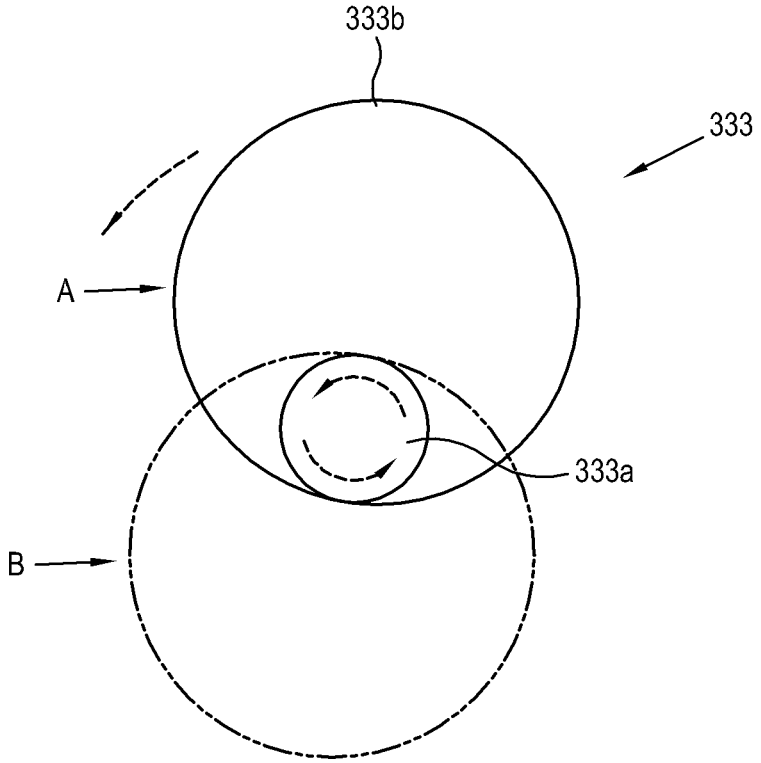
FIG. 2B illustrates the cam in the pressing position.
Figure 3B:
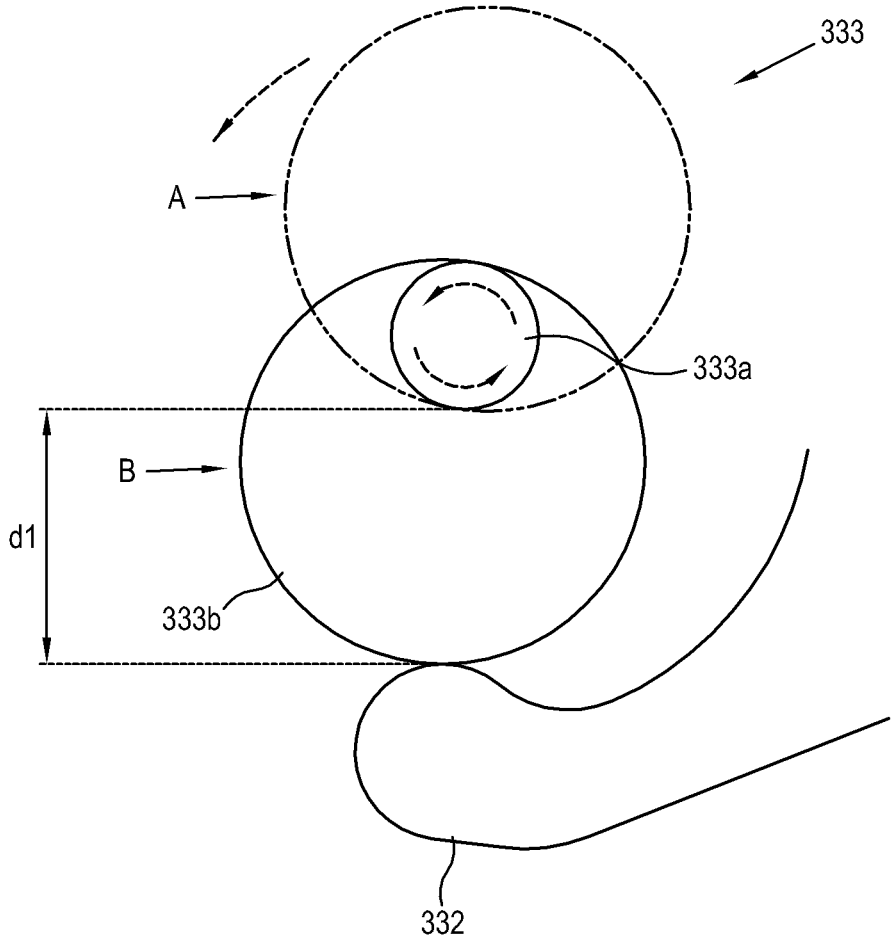
FIG. 3B illustrates the cam in the separated position.

FIGS. 2A and 3A are enlarged main portion views illustrating the states that the second roller support unit 320 is moved to a separated position A and a pressing position B. FIGS. 2B and 3B illustrate the position of the cam 333 in the separated position A and the pressing position B.

As illustrated in FIGS. 2A and 2B, the cam 333 may include a shaft portion 333*a* and a protruding portion 333*b*.

As the shaft portion 333*a* rotates, the protruding portion 333*b* also rotates and is moved in a rotation direction around the shaft portion 333*a*. Although the shaft portion 333*a* and the protruding portion 333*b* are labeled separately for clarity, they may be formed integrally of the same material and in the same manufacturing process.

If the protruding portion 333*b* of the cam 333 does not press the first end part 332*a* of the driving lever 332, the second roller support unit 320 is positioned in the separated position A separated from the intermediate image transfer belt 210. The image-forming apparatus 1 may include a controller to control a position of the cam 333. When a final image is not being transferred from the intermediate image transfer belt 210 to a recording medium, the controller may control the cam 333 so that the protruding portion 333*b* of the cam 333 does not press the first end part 332*a* of the driving lever 332, and the driving roller 220*a* and the recording medium transfer roller 320 are positioned in the separated position A.

As illustrated in FIGS. 3A and 3B, if the protruding portion 333*b* of the cam 333 does press the first end part 332*a* of the driving lever, the driving lever 332 rotates around the hinge pivot 331*a*, the second end 332*b* of the driving lever 332 pushes against the elastic member 335, which causes the roller support lever 321 to push the recording medium transfer roller 320 towards the driving roller 220*a* and the intermediate image transfer belt 210. In other words, once the final image is formed in the intermediate image transfer belt 210, the controller may cause the cam 333 to rotate. As the cam 333 rotates, the protruding portion 333*b* of the cam 333 presses the first end part 332*a* of the driving lever 332, and accordingly, the driving lever 332 revolves in a counterclockwise direction about the hinge pivot 331*a*. Also, the shaft support lever 321 connected to the second end part 332*b* of the driving lever 332 revolves in the counterclockwise direction about the revolution shaft 321*a*. Accordingly, the recording medium transfer roller 320 supported by the shaft support lever 321 gradually approaches the intermediate image transfer belt 210. A recording medium P is positioned between the intermediate image transfer belt 210 and the recording medium transfer roller 320. As the driving roller 220*a* presses against the recording medium transfer roller 320 the complete image on the intermediate transfer belt 210 is transferred onto the recording medium P.

The protruding portion 333*b* of the cam 333 has a length d1. When the protruding portion 333*b* presses against the first end part 332*a* of the driving lever 332, the first end part 332*a* of the driving lever 332 moves a distance d1 corresponding to the length d1 of the protruding portion 333*b*.

As illustrated in FIGS. 4A-4C and 5, the protrusion 325*a* on the positioning ring 325 may regulate or maintain a contact area between the recording medium transfer roller 320 and the driving roller 220*a*. That is, the recording medium transfer roller 320 moves until the protrusion 333*a* of the second roller support unit 320 contacts the first roller support unit 240. For convenience of description, FIG. 5 illustrates the driving roller 220*a* and the recording medium transfer roller 320 in the separated state, and the roller support lever 337 and the driving unit 330 are omitted.

Figure 4A:
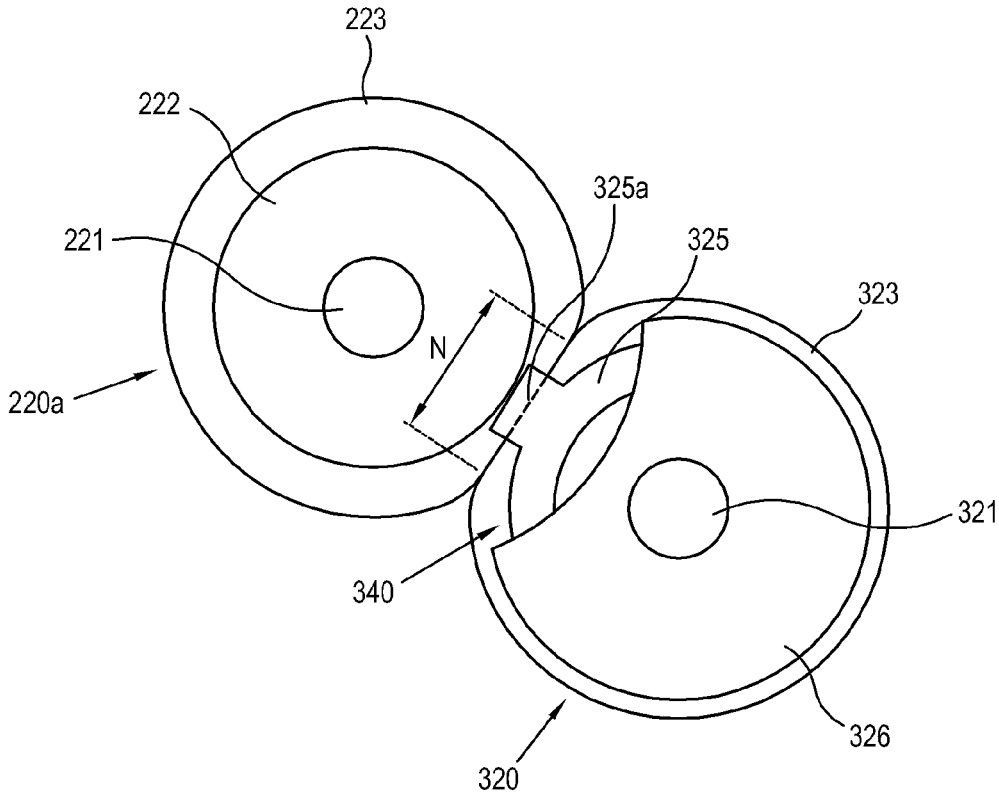
FIGS. 4A-4C are schematic views illustrating how the protrusion of the position regulating ring maintains a contact area when in the pressing position.

As illustrated in FIG. 4A, the elastic layer 223 of the driving roller 220 and the elastic layer 323 of the recording medium transfer roller 110 forcedly contact each other to generate a transferring contact region N, and the following Table 1 shows how the width of the transferring contact region N changes in a lengthwise direction thereof.

TABLE 1

| | conventional transferring contact region width | | | transferring contact region width of present general inventive concept | | |
|---|---|---|---|---|---|---|
| number of time | first end | second end | difference | first end | second end | difference |
| 1 | 3.08 | 3.89 | 0.81 | 3.20 | 3.21 | 0.01 |
| 2 | 3.55 | 4.48 | 0.93 | 3.48 | 3.52 | 0.04 |
| 3 | 3.33 | 4.04 | 0.71 | 3.18 | 3.47 | 0.29 |
| 4 | 3.79 | 4.81 | 1.02 | 3.41 | 3.67 | 0.26 |
| 5 | 3.69 | 4.56 | 0.87 | 3.16 | 3.29 | 0.13 |
| 6 | 3.39 | 4.24 | 0.85 | 3.29 | 3.53 | 0.24 |
| 7 | 3.77 | 4.69 | 0.92 | 3.22 | 3.39 | 0.17 |
| 8 | 3.68 | 4.58 | 0.90 | 3.36 | 3.43 | 0.07 |
| average | 3.54 | 4.41 | 0.88 | 3.29 | 3.44 | 0.15 |

In the above Table 1, the unit is mm, and 'first end' and 'second end' mean the width of a transferring contact region in the opposite end parts in a lengthwise direction of the transferring roller 320.

Figure 4B:
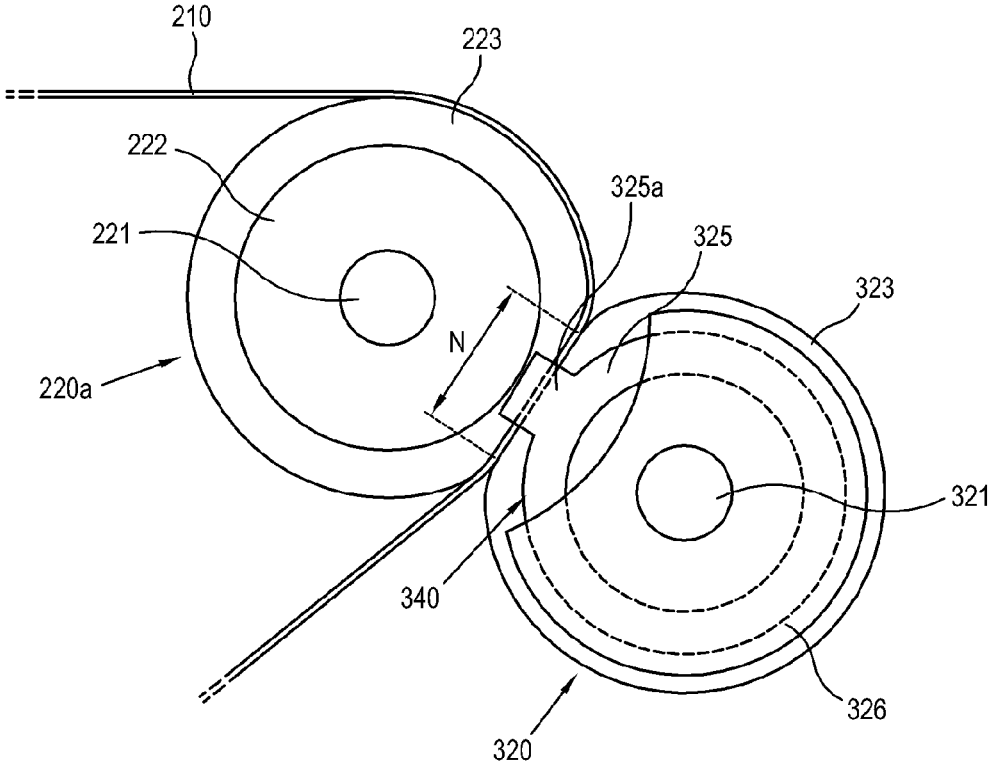
Figure 7:
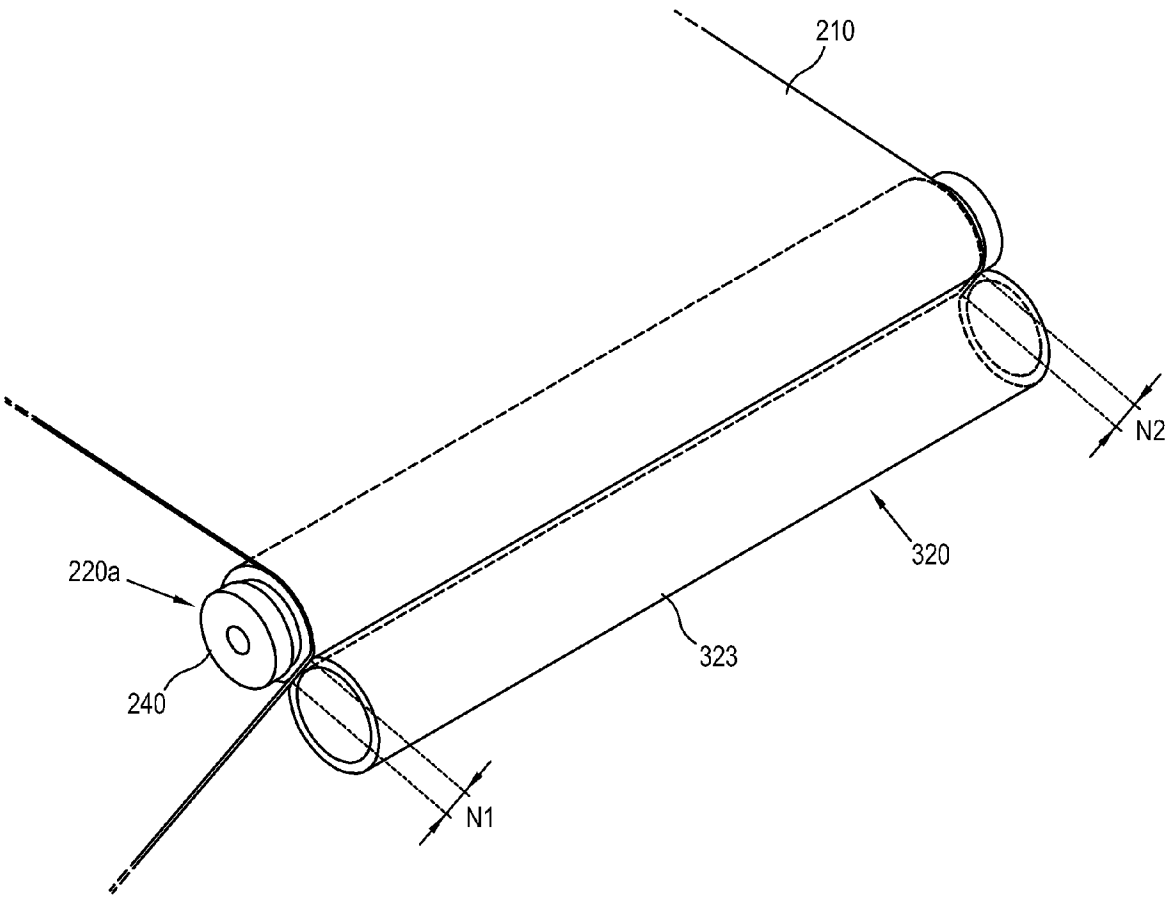
FIG. 7 illustrates contact areas at two ends of the image-transfer roller.

In other words, as illustrated in FIGS. 4B and 7, when the recording medium transfer roller 320 is moved into a pressing position with the driving roller 220*a*, the belt 210 that is located around an outer circumference of the driving roller 220*a* contacts the elastic layer 323 of the recording medium transfer roller 320. The contact portion of the belt 210 and the elastic layer 223 has a width N1 at a first end of the roller 320 and a width N2 at a second end of the roller 320 opposite the first end. The width of the contact portion N between the first end and second end of the roller 320 is generally between the width N1 and N2, although some variation may occur.

When a separating protrusion 325*a* is utilized at each end of the recording medium transfer roller 320 to maintain a constant width N along the length of the roller 320, the difference between the width N1 and N2 may be minimized, resulting in a more even transfer of an image from the intermediate image transfer belt 210 to the recording medium P.

Figure 4C:
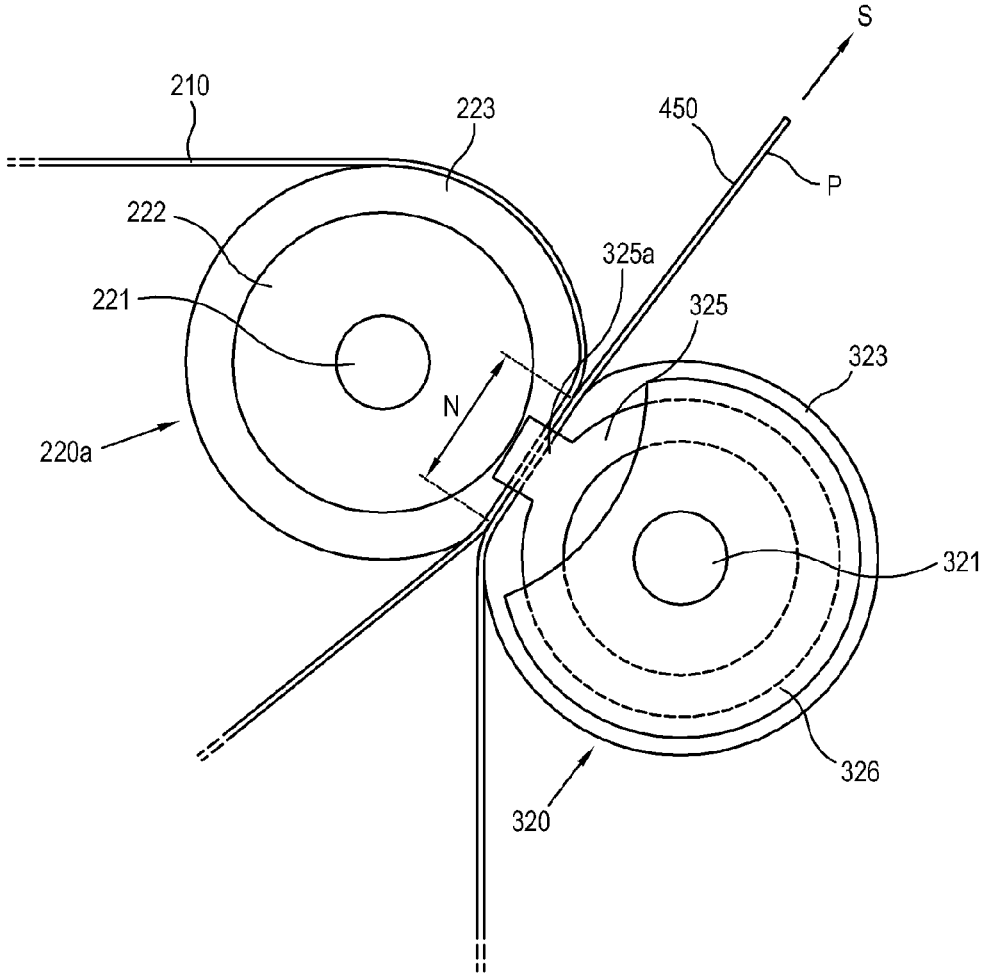

FIG. 4B illustrates the pressing position of the recording medium transfer roller 320 and the driving roller 220*a* with the belt 210 positioned between the rollers 320 and 220*a*. FIG. 4C illustrates the pressing position with the recording medium P located between the rollers 320 and 220*a*. FIG. 4A illustrates the pressing position without the intermediate image transfer belt 210 and the recording medium P for illustration. Although the width N may change slightly when the belt 210 and the recording medium P are located between the elastic layers 223 and 323 of the driving roller 220*a* and the recording medium transfer roller 320, respectively, the change is small. In addition, when a separating protrusion 325*a* is used to maintain the width N of the contact area between the driving roller 220*a* and the recording medium transfer roller 320, the consistency of the width N1 and N2 between the first and second ends of the rollers 220*a* and 320 is maintained whether or not the belt 210 and recording medium P are positioned between the first and second ends of the rollers 220*a* and 320.

Referring to Table 1 and FIG. 4A, the average value of the difference in widths N1 and N2 of the ends of the transferring contact region according eight separate tests of the difference in widths is 0.88 mm in an apparatus that does not include a separating protrusion 325*a* and 0.15 mm according to the present general inventive concept. In other words, the consistency of the width in the transferring contact region as measured by the difference in the widths N1 and N2 of the contact region at the ends of the rollers is improved by about 83% (=(0.88−0.15)/0.88) compared to a conventional image forming apparatus.

Accordingly, as the width N of the transferring contact region in the lengthwise direction can be maintained to be uniform, an image-transfer property can be improved, thereby improving an image quality.

As illustrated in FIG. 5, the first roller support unit 240 and the second roller support unit 340 may be respectively on opposite ends in the lengthwise direction of the driving roller 220*a* and the recording medium transfer roller 320. Accordingly, the pressing position B of the recording medium transfer roller 320 can be regulated and maintained constant by locating separating protrusions 325*a* at the opposite ends of the recording medium transfer roller 320 in the lengthwise direction.

When in the pressing position B, the separating protrusion 325*a* of the second roller support unit 340 may contact the first roller support unit 240.

The recording medium transfer roller 320 is maintained by the cam 333 in the pressing position B, illustrated in FIGS. 3A, 3B, and 4A-4C, until a printing medium P has entirely passed through between the intermediate image transfer belt 210 and the recording medium transfer roller 320.

As illustrated in FIGS. 3A and 3B, when the protruding portion 333*b* of the cam 333 presses the first end part 332*a* of the driving lever 332, the driving lever 332 rotates in the counterclockwise direction around the hinge pivot 331*a*. The elastic member 335 positioned between the second end part 332*b* of the driving lever 332 and the roller support lever 337 is compressed.

Accordingly, as shown in FIG. 3A, the elastic member 335 applies an elastic force F to the roller support lever 337.

As a result, recording medium transfer roller 320 is pressed against the intermediate image transfer belt 210 and the driving roller 220*a*. The recording medium transfer roller 320 applies the elastic force F to the driving roller 220*a*, and the transferring contact area having a width N is formed where the recording medium transfer roller 320 presses against the driving roller 220*a* via the belt 210.

Since the movement of the recording medium transfer roller 320 is regulated by the contact of the separating projection 325*a* with the first roller support unit 240, the transferring contact region can be maintained to be substantially uniform.

Accordingly, a final visible image on the intermediate transferring belt 210 can have a uniform transferring property in the lengthwise direction of the recording medium transfer roller 320, thereby improving a printing quality.

After a rear end of the printing medium passes through the transferring contact region, the cam 333 may return to the position in FIGS. 2A and 2B. The, the cam 333 may be driven by an electronic motor (not shown), for example.

The image forming apparatus 1 may further include a control unit (not shown) controlling the printing processes of the image-forming apparatus 1 including operation of the cam 333.

As the cam 333 returns to the position in FIG. 2, the second roller support unit 320 also returns to the separated position A illustrated in FIG. 2 by the elastic force F of the elastic member 335.

Figure 8A:
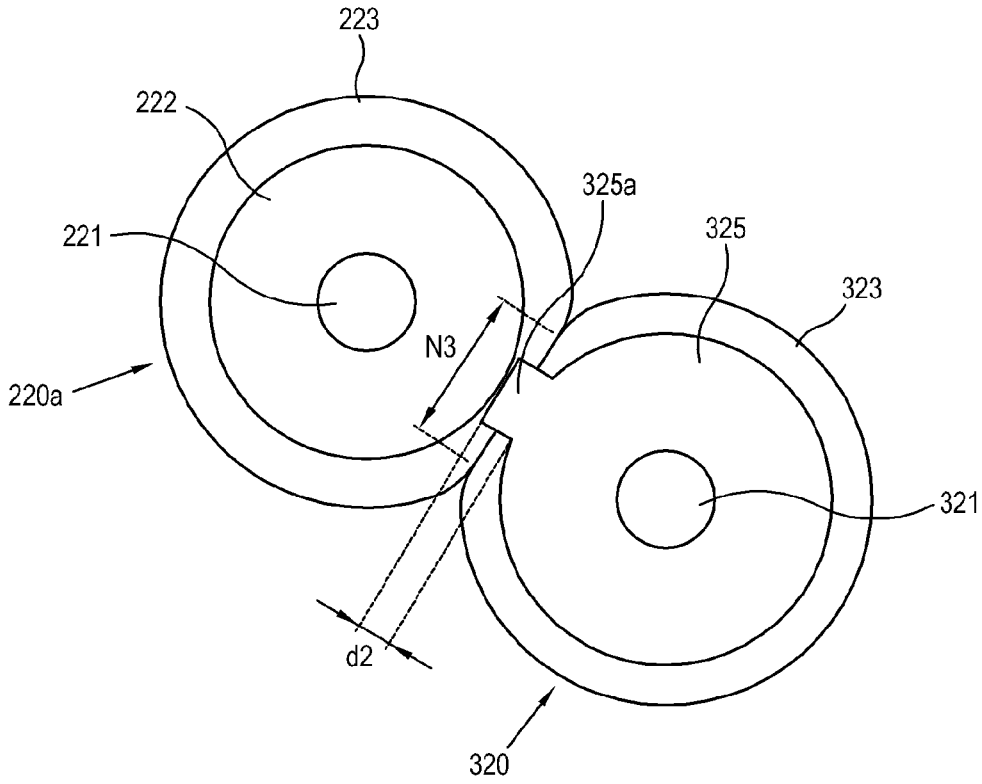
FIGS. 8A and 8B illustrate different lengths of the protrusion of the position regulating ring.
Figure 8B:
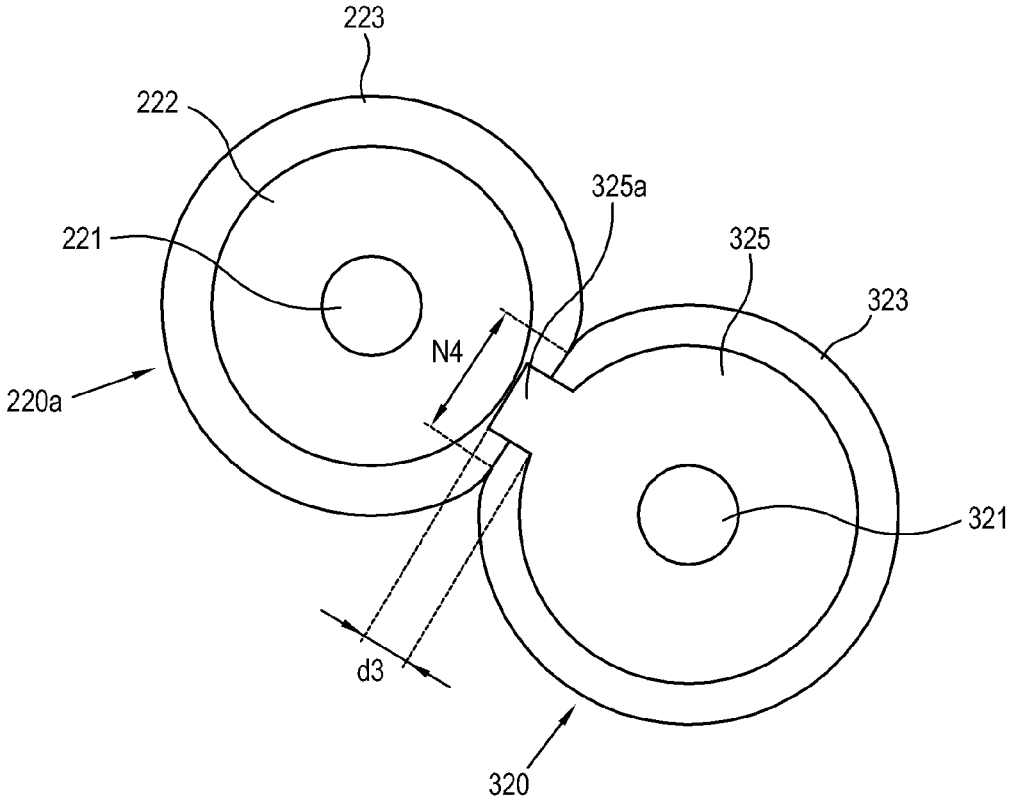

The width N of the contact region or contact area between the elastic layer 323 of the recording medium transfer roller 320 and the elastic layer 223 of the driving roller 220*a* may be adjusted by adjusting a length of the separating protrusion 325*a*. As the length of the separating protrusion 325*a* is increased, the width N of the contact area may decrease. As illustrated in FIGS. 8A and 8B, when the separating protrusion 325*a* has a first length d2, the contact area has a first width N3. When the length of the separating protrusion 325*a* is increased to d3, the width N4 of the contact area decreases. The decrease in width N4 may be proportional to the increase in length d2, d3, for example.

Figure 9A:
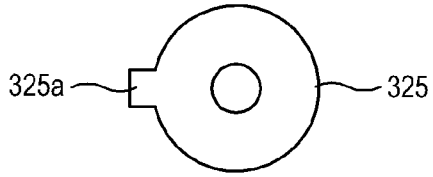
FIGS. 9A-9E illustrate different shapes of position-regulating ring protrusions.
Figure 9B:
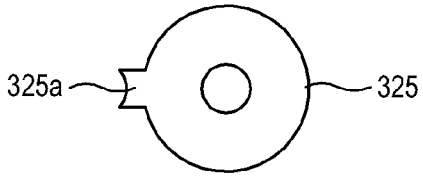
Figure 9C:
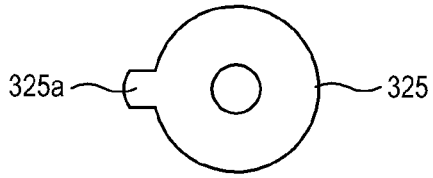
Figure 9D:
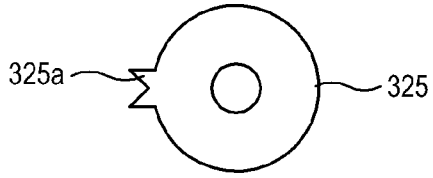
Figure 9E:
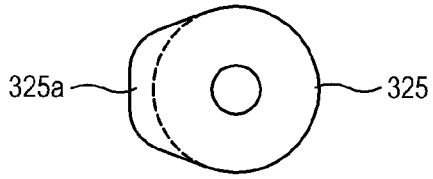

The separating protrusion 325*a* may be of any appropriate shape. FIGS. 9A-9E illustrate various shapes of separating protrusions 325*a*, but any shape may be used. FIG. 9A illustrates a rectangular protrusion 325*a*, FIG. 9B illustrates a protrusion 325*a* having a concave-curved end, FIG. 9C illustrates a protrusion 325*a* having a convex-curved end, FIG. 9D illustrates a protrusion 325*a* having a convex angular recess at its end, and FIG. 9E illustrates a protrusion 325*a* having a width that is substantially the same or similar to a diameter of the positioning ring 325.

Figure 12:
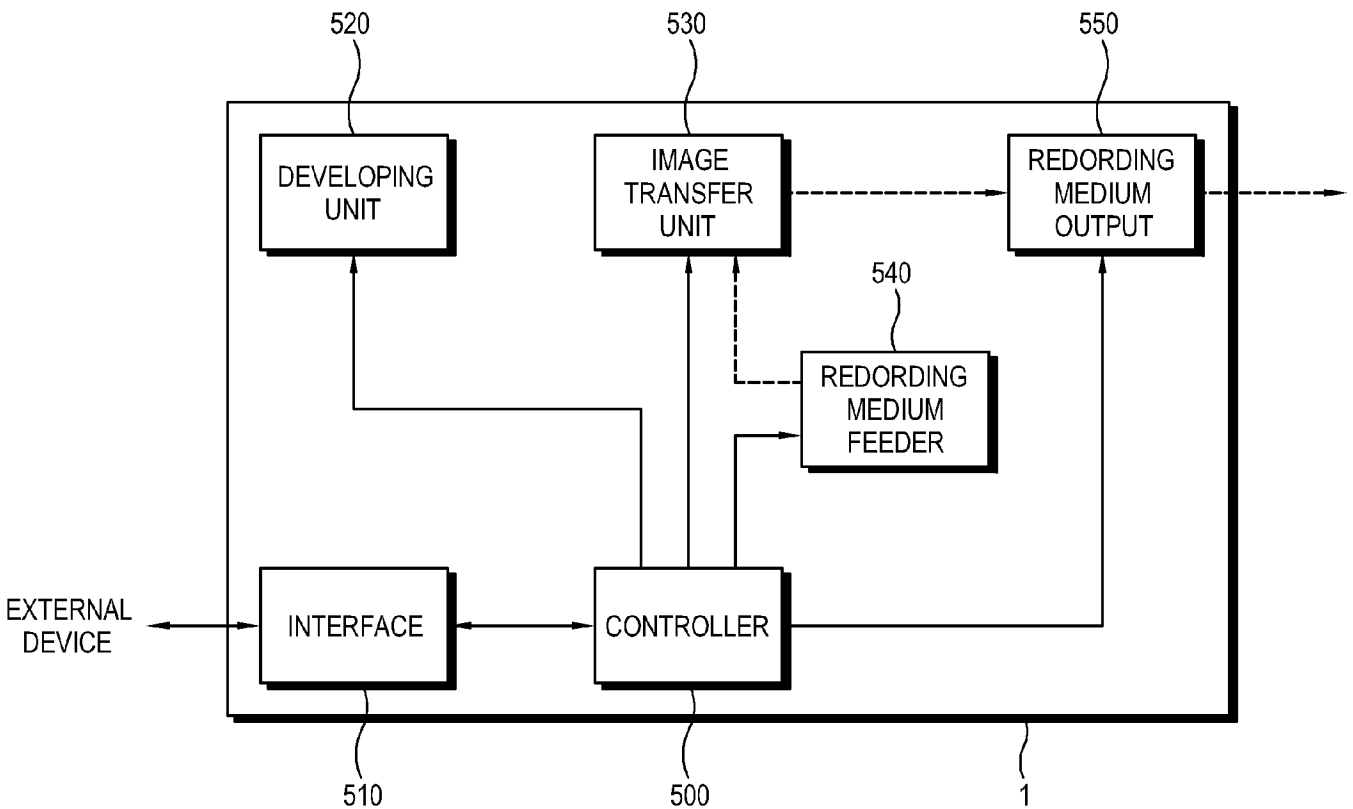
FIG. 12 illustrates a block diagram of an image-forming apparatus according to an embodiment of the present general inventive concept.

FIG. 12 illustrates a block diagram of an image-forming apparatus 1 according to an embodiment of the present general inventive concept. The image-forming apparatus 1 may include a controller 500 to control operation of the image-forming apparatus, an interface 510 to receive image data, power, and other signals and data to cause the controller 500 to operate the image-forming apparatus, a developing unit 520 to develop an image, an image-transfer unit 530 to transfer the image to a recording medium, a recording medium feeder 540 to provide a recording medium to the image-transfer unit 530, and a recording medium output 550 to output the recording medium.

For example, if the image is a multi-color image and the recording medium is paper, the interface 510 may receive data corresponding to the image. The interface 510 may include a data communication port to communicate with an external device, data storage to store data within the image-forming apparatus 1, and/or a user interface to receive data directly from a user input. The controller 500 may control operation of the developing unit 520 based on the received image data. The developing unit 520 may include the developing cartridges 140, image-carrying body 110, charging roller 120 and exposing unit 130 of FIG. 1, for example.

The developing unit 520 may transfer the image to the image-transfer unit 530, and the image-transfer unit 530 may transfer the image to the paper. The image-transfer unit 530 may include the intermediate image-transfer rollers 220, 220*a*, 230 and belt 210 of the intermediate image-transfer unit 200 of FIG. 1. The image-transfer unit 530 may also include the recording medium transfer unit 300 of FIG. 1, including the recording medium transfer roller 320 and the separating protrusion 325*a*, and the fusing unit 400.

The recording medium feeder 540 may feed the paper to the image-transfer unit 530 to have the image transferred from the belt 210 to the paper. The recording medium feeder 540 may include one or more rollers, a storage area, and supporting circuitry, for example. The recording medium feeder 540 may feed the paper to the image-transfer unit 530 along the path S of FIG. 1. Upon exiting the fuser 400, the recording medium output 450 may output the paper to a storage area via one or more rollers or any other paper path or conduit.

As described above, an image forming apparatus, a transferring unit and a intermediate transferring unit according to the present general inventive concept have the following features.

First, a transferring contact region formed between a driving roller and a recording medium transfer roller can be uniform in a lengthwise direction.

Second, a transferred amount of a developer transferred to a printing medium in a lengthwise direction of the printing medium can be maintained uniformly, thereby improving a printing quality.

Third, a transferring contact region can be uniformly maintained by a relatively simple configuration.

Fourth, uniformity of a transferring contact region can be maintained with a high reliability.

Although a few exemplary embodiments of the present general inventive concept have been shown and described, it will be appreciated by those skilled in the art that changes may be made in these exemplary embodiments without departing from the principles and spirit of the general inventive concept, the scope of which is defined in the appended claims and their equivalents.

What is claimed is:

1. An image forming apparatus of an electrophotographic type, the image forming apparatus comprising:

an image carrying body;

an intermediate transferring unit including an intermediate transferring belt to which a visible image on the image carrying body is transferred, a driving roller to drive the intermediate transferring belt, and a first roller support unit to support a rotation shaft of the driving roller; and a medium transferring unit to transfer a visible image from the intermediate transferring belt to a printing medium, the medium transferring unit including a transferring roller to move between a pressing position pressing the driving roller and a separated position separated from the driving roller, and a second roller support unit to support a rotation shaft of the transferring roller, wherein the pressing position of the transferring roller is regulated by a contact of the first roller support unit and the second roller support unit.

2. The image forming apparatus according to claim 1, wherein one of the first roller support unit and the second roller support unit includes a bearing, and the other of the first roller support unit and the second roller support unit includes a position regulating ring including a protrusion to protrude toward the bearing.

3. The image forming apparatus according to claim 2, wherein the second roller support unit further includes a bearing to support a rotation shaft of the driving roller, and the position regulating ring is located around an outer circumference of the bearing of the second roller support unit.

4. The image forming apparatus according to claim 1, wherein the second roller support unit rotates between the pressing position and the separated position.

5. The image forming apparatus according to claim 1, wherein the medium transferring unit further includes a driving unit to move the transferring roller to the separated position and the pressing position, respectively.

6. The image forming apparatus according to claim 1, wherein the driving unit comprises:

an elastic member to elastically bias the transferring roller to the separated position; and an operating unit to move the transferring roller to the pressing position.

7. The image forming apparatus according to claim 6, wherein the operating unit comprises:

a driving lever to rotate about a hinge pivot being in parallel with a rotation shaft of the transferring roller, and to drive the second roller support unit; and a cam to press a first end part of the driving lever.

8. The image forming apparatus according to claim 7, wherein the elastic member is located between a second end part of the driving lever and the second roller support unit.

9. A transferring unit in an image forming apparatus having an image carrying body, an intermediate transferring belt to which a visible image on the image carrying body is transferred, a driving roller to drive the intermediate transferring belt, and a first roller support unit to support a rotation shaft of the driving roller and to transfer a visible image on the intermediate transferring belt to a printing medium, the transferring unit comprising:

a transferring roller to move between a pressing position in which the transferring roller is pressed against the driving roller, and the intermediate transferring belt is located between the transferring roller and the driving roller, and a separated position in which the transferring roller is separated from the driving roller; and a second roller support unit to support a rotation shaft of the transferring roller, wherein the pressing position of the transferring roller is regulated by a contact of the first roller support unit and the second roller support unit.

10. The transferring unit according to claim 9, wherein one of the first roller support unit and the second roller support unit includes a bearing, and the other of the first roller support unit and the second roller support unit includes a position regulating ring having a protrusion protruding toward the bearing of the first roller support unit.

11. The transferring unit according to claim 10, wherein the second roller support unit includes a bearing to support the rotation shaft of the driving roller, and the position regulating ring is located around an outer circumference of the bearing of the second roller support unit.

12. An intermediate transferring unit located in an image forming apparatus, the intermediate transferring unit comprising:

an intermediate transferring belt to which a visible image on an image carrying body in the image forming apparatus is transferred;

a driving roller to drive the intermediate transferring belt; and a position regulating ring connected to a rotation shaft of the driving roller and including a separating protrusion protruding from an outer edge of the position regulating ring.

13. The intermediate transferring unit according to claim 12, further comprising:

a first bearing to support the rotation shaft of the driving roller, wherein the position regulating ring is located around an outer surface of the first bearing.

14. The intermediate transferring unit according to claim 12, wherein the image forming apparatus comprises a medium transferring unit to transfer a visible image on the intermediate transferring belt to a printing medium, the medium transferring unit including a transferring roller to move between a pressing position pressing the medium transferring roller to the driving roller to interpose the intermediate transferring belt therebetween and a separated position in which the transferring roller is separated from the driving roller, and a roller support unit to support a rotation shaft of the transferring roller, and the pressing position of the transferring roller is regulated by a contact of the position regulating ring and the roller support unit.

15. The intermediate transferring unit according to claim 14, wherein the roller support unit includes a second bearing supporting the rotation shaft of the transferring roller.

16. The intermediate transferring unit according to claim 14, wherein the roller support unit rotates between the pressing position and the separated position.

17. An image-forming apparatus, comprising:

an intermediate image-transfer unit including an intermediate image transfer belt to receive an image to transfer to a recording medium and a driving roller to drive the intermediate image transfer belt;

a recording medium transfer roller to move to an image transfer position in contact with the driving roller, wherein one of the recording medium transfer roller and the driving roller includes at least one roller separation protrusion to maintain at a predetermined distance the driving roller and the recording medium transfer roller when the driving roller and the recording medium transfer roller are in the image transfer position.

18. The image-forming apparatus according to claim 17, wherein the separation protrusion is located on a roller support unit to support a shaft of one of the driving roller and the recording medium transfer roller.

19. The image-forming apparatus according to claim 18, wherein the roller support unit comprises:

a bearing to support a shaft of one of the first driving roller and the recording medium transfer roller; and a positioning ring located around an outer circumference of the bearing, wherein the separation protrusion extends from an outer circumferential surface of the positioning ring.

20. The image-forming apparatus according to claim 17, wherein the separation protrusion is located on a shaft of one of the driving roller and the recording medium transfer roller.

21. The image-forming apparatus according to claim 17, wherein the recording medium transfer roller includes a first roller support unit to support a shaft of the recording medium transfer roller and the driving roller includes a second roller support unit to support a shaft of the driving roller, the separation protrusion is located on one of the first and second roller support units, and the separation protrusion located on one of the first and second roller support units contacts an outer circumferential surface of the other of the first and second roller support units.

22. The image-forming apparatus according to claim 17, wherein the separating protrusion is located on the recording medium transfer roller and extends towards the driving roller.

23. The image-forming apparatus according to claim 17, wherein the separating protrusion is located on the driving roller and extends towards the recording medium transfer roller.

24. An image-transfer apparatus of an image-forming apparatus, the image-transfer apparatus comprising:

a first image-transfer unit including a first roller, the first image-transfer unit to receive a multi-color image; and a second image-transfer unit including a second roller to move to an image transfer position in contact with the first roller and to a separated position separate from the first roller;

wherein one of the first roller and the second roller includes at least one roller separation protrusion to maintain the first roller and the second roller at a predetermined distance from each other when the first roller and the second roller are in the image transfer position.

* * * * *